US006854702B2

(12) United States Patent
Manthei et al.

(10) Patent No.: US 6,854,702 B2
(45) Date of Patent: Feb. 15, 2005

(54) FORM FOR MANUFACTURING CONCRETE BLOCKS FOR FREESTANDING WALLS

(75) Inventors: Benjamin R. Manthei, Petoskey, MI (US); James A. Manthei, Petoskey, MI (US)

(73) Assignee: Redi-Rock International, LLC, Charlevoix, MI (US)

( * ) Notice: Subject to any disclaimer, the term of this patent is extended or adjusted under 35 U.S.C. 154(b) by 0 days.

(21) Appl. No.: 10/337,796

(22) Filed: Jan. 7, 2003

(65) Prior Publication Data

US 2003/0127581 A1 Jul. 10, 2003

Related U.S. Application Data

(63) Continuation-in-part of application No. 09/670,924, filed on Sep. 28, 2000, now Pat. No. 6,557,818.

(60) Provisional application No. 60/346,726, filed on Jan. 7, 2002, and provisional application No. 60/156,889, filed on Sep. 30, 1999.

(51) Int. Cl.[7] ..... B41B 11/52; E02D 29/02; E04C 2/04

(52) U.S. Cl. ..... 249/171; 249/52; 249/176; 249/101; 405/284; 405/286; 52/596; 52/605; 52/425; 52/442; 52/443; 52/436 R

(58) Field of Search ..... 249/52, 98, 140, 249/160, 161, 101–104, 170–172, 176, 179; 405/284, 286; 264/239, 247, 256, 333, 271.1; 425/304, 436 R, 436 RM, 442, 443; 52/100, 596, 604–609; D25/113, 115

(56) References Cited

U.S. PATENT DOCUMENTS

| | | | | |
|---|---|---|---|---|
| 767,829 A | * | 8/1904 | Ozee | 425/412 |
| 770,677 A | | 9/1904 | Cuatt | |
| 788,481 A | * | 4/1905 | Lightner | 249/140 |

(List continued on next page.)

FOREIGN PATENT DOCUMENTS

| | | | | |
|---|---|---|---|---|
| EP | 433591 A2 | | 6/1991 | |
| FR | 2616703 | * | 12/1988 | 249/52 |
| GB | 2117313 A | | 10/1983 | |

*Primary Examiner*—Jong-Suk Lee
(74) *Attorney, Agent, or Firm*—MacMillan, Sobanski & Todd, LLC

(57) ABSTRACT

A form for manufacturing concrete blocks for constructing freestanding walls. The form includes a base and four side panels which are mounted on the base to pivot between a first position for casting a block and a second position for removing a cast block from the form. An insert is secured to the base for forming one end surface on the block and inserts are attached to the side panels for forming sides, top and bottom surfaces of the block. The inserts which form exposed sides of the block are textured to simulate natural stone. The inserts which form the top and bottom of the blocks form an interlocking connection which prevents stacked blocks from moving in a horizontal plane. Optionally, inserts used to form the top surface of blocks which will define the top of the wall may form a trough which is sufficiently deep to receive soil and plants.

3 Claims, 9 Drawing Sheets

U.S. PATENT DOCUMENTS

| | | | | | |
|---|---|---|---|---|---|
| 788,955 | A | | 5/1905 | Shone | |
| 789,996 | A | * | 5/1905 | McCullough | 249/172 |
| 799,754 | A | * | 9/1905 | Petrie | 249/104 |
| 887,814 | A | | 5/1908 | Johnson | |
| 987,225 | A | * | 3/1911 | Fobes | 249/144 |
| 1,166,312 | A | * | 12/1915 | Barten | 249/76 |
| 1,332,246 | A | * | 3/1920 | Coates | 249/112 |
| 1,534,353 | A | | 4/1925 | Besser | |
| 1,581,797 | A | * | 4/1926 | Fey | 249/172 |
| 1,767,163 | A | * | 6/1930 | Ackermann | 249/102 |
| 3,595,518 | A | | 7/1971 | Gaudelli et al. | |
| 4,063,866 | A | | 12/1977 | Lurbiecki | 425/517 |
| 4,790,508 | A | | 12/1988 | Henderson et al. | 249/11 |
| 4,869,660 | A | * | 9/1989 | Ruckstuhl | 425/195 |
| 4,909,717 | A | | 3/1990 | Pardo | 425/138 |
| 5,062,610 | A | | 11/1991 | Woolford et al. | 249/52 |
| 5,217,630 | A | * | 6/1993 | Sayles | 249/52 |
| 5,337,527 | A | | 8/1994 | Wagenaar | 52/169.2 |
| 5,589,124 | A | | 12/1996 | Woolford et al. | 264/157 |
| 5,817,248 | A | | 10/1998 | Forlini | 249/68 |
| 6,029,943 | A | | 2/2000 | Sievert | 249/52 |
| 6,138,983 | A | | 10/2000 | Sievert | 249/114.1 |

* cited by examiner

FORM FOR MANUFACTURING CONCRETE BLOCKS FOR FREESTANDING WALLS

CROSS-REFERENCE TO RELATED APPLICATIONS

Applicants claim priority to U.S. Provisional Patent Application Ser. No. 60/346,726 filed Jan. 7, 2002, and is a continuation in part of U.S. patent application Ser. No. 09/670,924 filed Sep. 28, 2000 now U.S. Pat. No. 6,557,818 which claims priority to provisional application No. 60/156,889 filed Sep. 30, 1999.

STATEMENT REGARDING FEDERALLY SPONSORED RESEARCH OR DEVELOPMENT

Not Applicable.

TECHNICAL FIELD

The invention relates to a form for manufacturing concrete blocks for constructing freestanding retaining walls.

BACKGROUND OF THE INVENTION

Concrete blocks are frequently used for constructing retaining walls. Rectangular blocks have been stacked to form a retaining wall and then back filled on one side to form a terrace. The backfill can exert a sufficient force on the retaining wall blocks to cause the stacked blocks to move out of their original position. In some cases, the blocks are stacked to form a stepped wall so that the front face of each row or tier of blocks is offset slightly behind the front face of the adjacent lower row of blocks. Further, a raised lip has sometimes been formed along the upper edge of the block adjacent the front face to prevent the stepped blocks from sliding out of position, as shown in Arvai et al. U.S. Pat. No. 5,791,827. In order to eliminate this problem, retaining wall blocks have sometimes been formed with a groove extending along a bottom surface parallel to an exposed face of the block and a raised portion is formed on a top surface to extend parallel to the front face. The groove on a stacked block receives the raised portion on an adjacent lower block for maintaining alignment of the front faces of the stacked blocks. Such an arrangement is shown, for example, in Forlini U.S. Pat. No. 5,647,185. Retaining wall blocks also may be formed with round knobs on the top surface which fit into a groove on the bottom surface of a stacked block to permit forming a curved retaining wall, as shown in Wagenaar U.S. Pat. No. 5,337,527. Concrete blocks manufactured for retaining walls have generally not been used for constructing freestanding walls due to the lack of stability and frequently unattractive appearance of one or more of the exposed sides of the blocks.

Another application for concrete blocks and wall panels is to construct freestanding walls. In one type of freestanding wall, large precast wall panels are secured between steel I-beams which are set into a concrete foundation. Such walls have been used, for example, as sound barriers separating highways from residential and business areas. Most existing concrete blocks have not been suitable for constructing freestanding walls due to their rough appearance and lack of stability when stacked. It has been difficult to cast concrete blocks which can interlock to form a strong freestanding wall and which have a pleasing appearance on all exposed sides.

SUMMARY OF THE INVENTION

The invention is directed to a form for manufacturing concrete blocks for use in constructing retaining walls in which the sides of the blocks which are exposed have a texture which simulates natural stone and to a method for casting such blocks. In a wall constructed from the blocks, at least two opposite sides of each block will be visible and ends of the blocks at an end of the wall may be visible. The form consists of a base and four side panels which are attached to the base to pivot between a first position for casting a block and a second position for removing a cast block from the form. When in the first position, the form sides are connected together to form a cavity in which a block is cast. The block is cast in the form with one end down and an opposite end at an open top of the form. Inserts are attached to two opposed side panels of the form. Each insert has a side which is textured to impart a desired natural stone texture to the side of the block formed by the insert. For blocks which will be used at an exposed end of the wall, an insert is mounted on the bottom of the form to impart a similar natural stone texture to the end of the block which is formed by the insert. Preferably, the inserts are formed from a resilient material which is easily released from the hardened concrete.

Depending on the application, of the block, various inserts may be attached to the other two opposed side panels of the form for imparting a desired configuration to the top and bottom of the block. Where the blocks are to be used in a lowermost tier of a wall, the inserts may be omitted to provide a flat bottom to the block. Where two blocks are to be stacked in a wall, inserts may be used for imparting shapes to the bottom of an upper block and to the top of the lower block which will interlock to prevent lateral movement of the upper block on the lower block the help stabilize the wall. The top surface of blocks which will form the top of the wall may be flat, or may be shaped to form a trough in which soil may be added for growing plants on the top of the wall.

Accordingly, it is an object of the invention to provide a form which is easily adapted with different inserts for manufacturing concrete wall blocks for constructing freestanding walls in which exposed sides of the blocks are textured to imitate natural stone.

Other objects and advantages of the invention will be apparent from the following description.

DETAILED DESCRIPTION OF THE INVENTION

Figure 1:
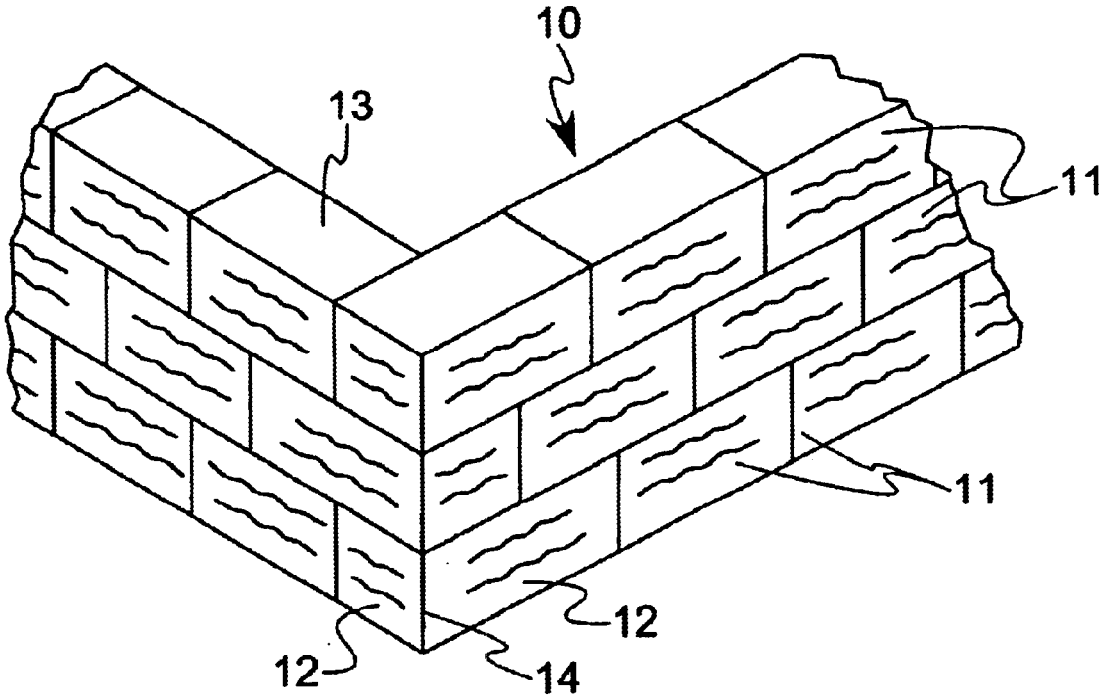
FIG. 1 is a fragmentary perspective view of an exemplary freestanding wall constructed with concrete blocks according to the invention, with the wall shown with a corner.

Referring to FIG. 1 of the drawings, a fragmentary portion of a three tier freestanding wall 10 is illustrated. It should be appreciated that the wall 10 may have more or fewer tiers. The illustrated wall 10 has a corner 14 forming a 90 degree bend. The wall is formed from cast concrete blocks 11. The blocks 11 have exposed sides 12 which are textured and also may be colored to provide a desired appearance. The example, the exposed sides 12 may be shaped and colored to imitate sandstone blocks, or slate or other natural stone. Since both sides of the freestanding wall 10 will be visible, both sides of the blocks 11 are textured. The wall 10 is shown with the blocks 11 in the uppermost tier forming a flat top 13. However, as will be discussed below, the top 13 may not be flat. Also, the blocks in adjacent tiers forming the wall 10 are interlocked together to provide stability.

Figure 2:
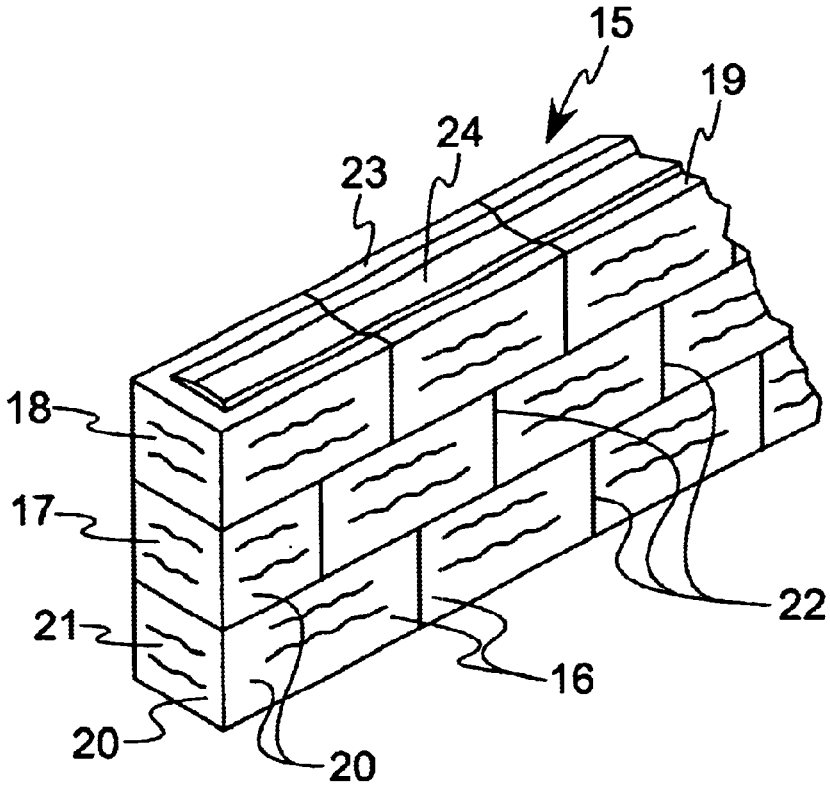
FIG. 2 is fragmentary perspective view of a straight section of a modified freestanding wall constructed with concrete blocks according to the invention, with the top tier of blocks forming a trench for filling with soil and plants.

FIG. 2 shows a fragmentary portion of a three tier straight wall 15 formed from full blocks 16, half length blocks 17, and top blocks 18 and 19. The wall 15 also may have more or fewer tiers, depending on the desired height for the wall and the height of the blocks. The blocks 16–19 are precast from concrete with textured and, optionally, colored, sides 20 which preferably imitate natural stone or other aesthetically pleasing materials. The half length block 17 is used in alternate tiers of blocks 15 forming the wall 15 at a free end 21 of the wall to offset joints 22 between the blocks in adjacent tiers. The top blocks 18 and 19 are shown as having upper surfaces 23 forming a recessed trough 24 which may be filled with soil and plants to form an attractive top to the wall 15. The block 18 is located at the end 21 of the wall 15 for closing the end of the trough 24.

Figure 3:
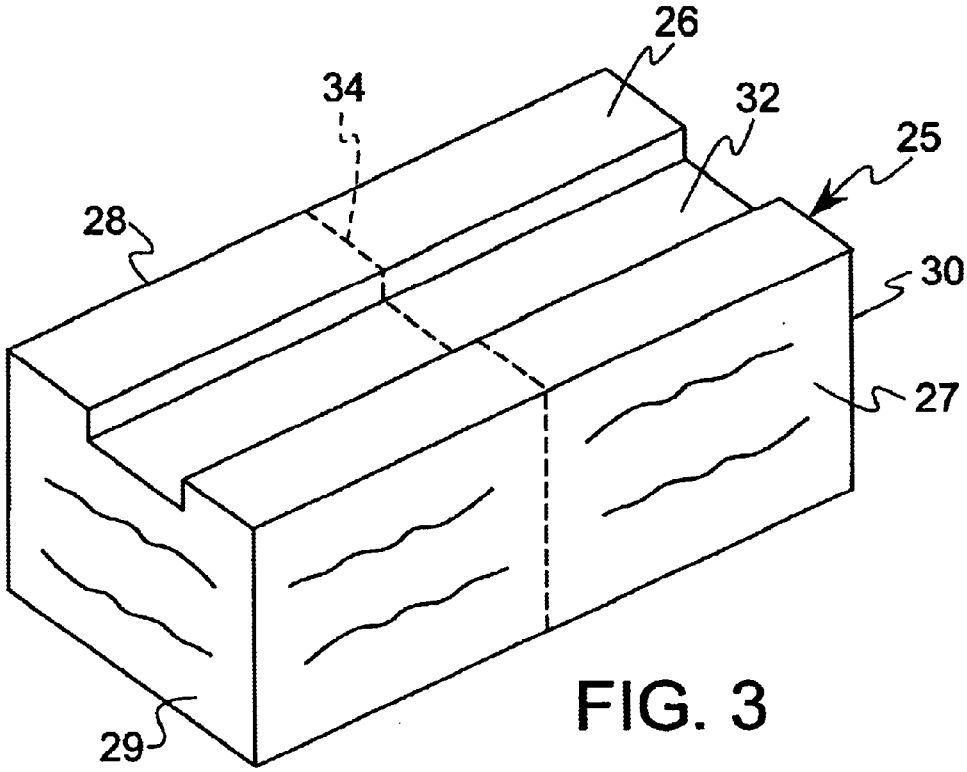
FIG. 3 is a top perspective view of a cast concrete block according to a first embodiment of the invention.
Figure 4:
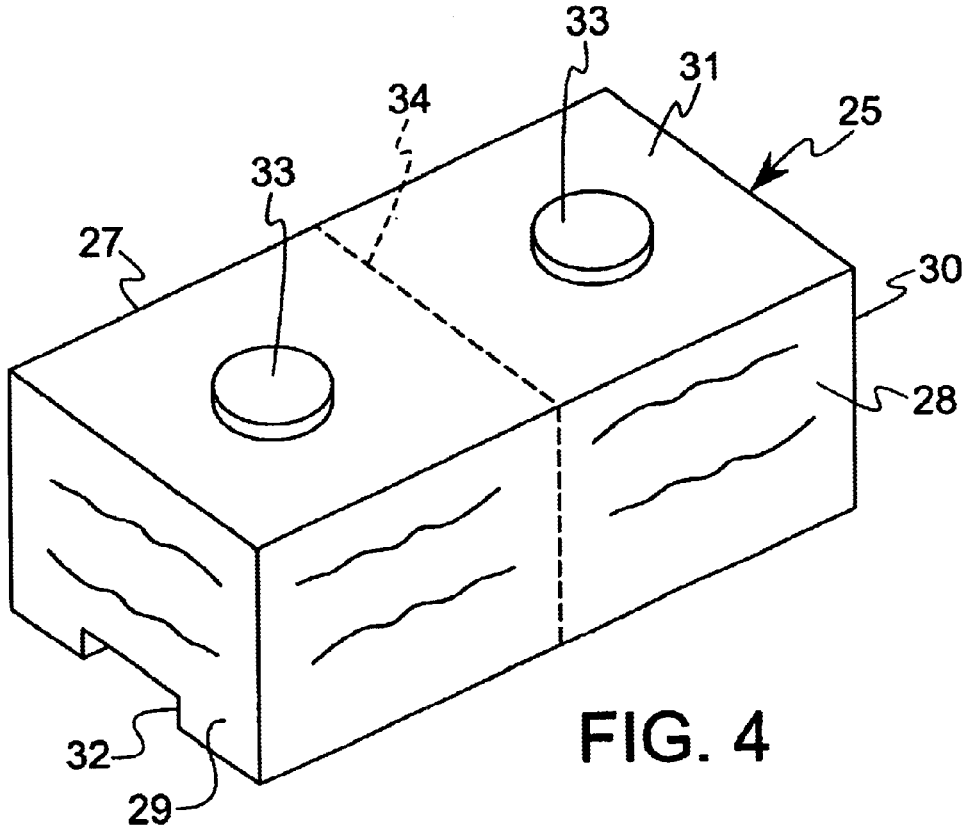
FIG. 4 is a bottom perspective view of the cast concrete block of FIG. 3.

FIG. 3 is a top perspective view of a concrete block 25 which may be used in constructing the freestanding walls 10 and 15, and FIG. 4 is a bottom perspective view of the block 25. The block 25 has a grooved top 26, textured sides 27 and 28, ends 29 and 30 and a bottom 31. One or both of the ends 29 and 30 also may be textured and will be textured when they are visible in a finished wall. The top 26 has a longitudinal groove 32 which is shown extending the full length of the block 25. However, it should be appreciated that the groove 32 may stop short of one or of both ends 29 and 30. Two shallow knobs 33 are formed on the bottom 31 of the block 25. The knobs 33 are shown as being round. However, the knobs 33 may have other shapes, such as an oval or an elliptical or a semi-spherical shape. The groove 32 in the top of the block is sized and shaped to receive the knobs 33. When the blocks 25 are stacked in tiers, the bottom knobs 33 on upper blocks extend into the top grooves 32 on the adjacent lower blocks 25 to keep the stacked blocks vertically aligned. For the lowermost tier of blocks 25 which will rest on the ground, the bottom knobs 33 may be omitted. For a half block, the block 25 is formed to one half of its full length, as shown by the dashed line 34. It should be appreciated that the blocks may be inverted so that the knobs 33 are on the top surface and the groove 32 is on the bottom surface.

Figure 5:
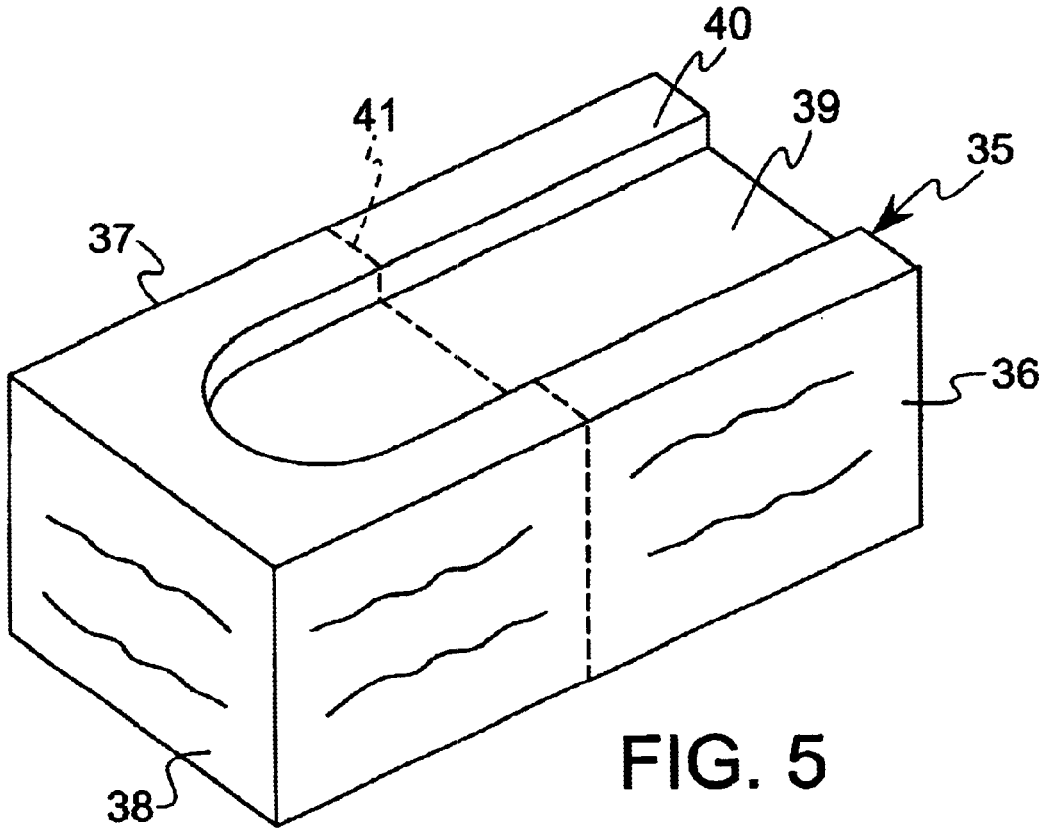
FIG. 5 is a top perspective view of a cast concrete block according to a second embodiment of the invention.

FIG. 5 is a perspective view of a block 35 suitable for use in an exposed or free end of a freestanding wall. The block 35 has sides 36 and 37 and an end 38 which are textured and also may be colored to imitate a desired material, such as natural stone. The block 35 has a recess 39 in a top surface 40 which stops short of the end 38, so as to not be visible when viewing the exposed end of a wall in which the block 35 is used. A half block is made by casting the portion of the block 35 including the textured end 38 and stopping at a length shown by a dashed line 41.

Figure 6:
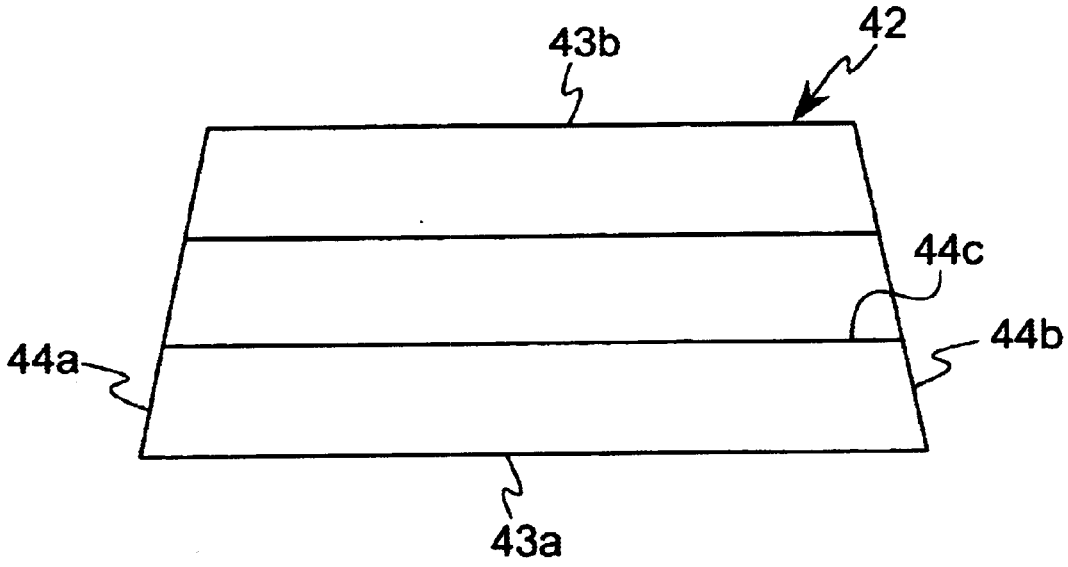
FIG. 6 is a top plan view of a cast concrete block according to a third embodiment of the invention.

FIG. 6 is a top plan view of a block 42 which can be used for forming a curved freestanding wall. The block 42 has a trapezoidal shape in plan, having a side 43*a* which is slightly longer than an opposite side 43*b*. Ends 44*a* and 44*b* of the block 42 preferably form equal and opposite angles to the sides 43*a* and 43*b*. In an example block 42, the side 43*a* was 46 inches long, the side 43*b* was 42.5 inches long, the width of the block was 24 inches and the height was 18 inches. The block 42 is shown as having a top groove 44*c* which extends between the ends 44*a* and 44*b* and parallel to the sides 43*a* and 43*b*. It will be appreciated that the width of the blocks can be increased when the height of a freestanding wall constructed from the blocks will be increased in order to maintain stability.

Figure 7:
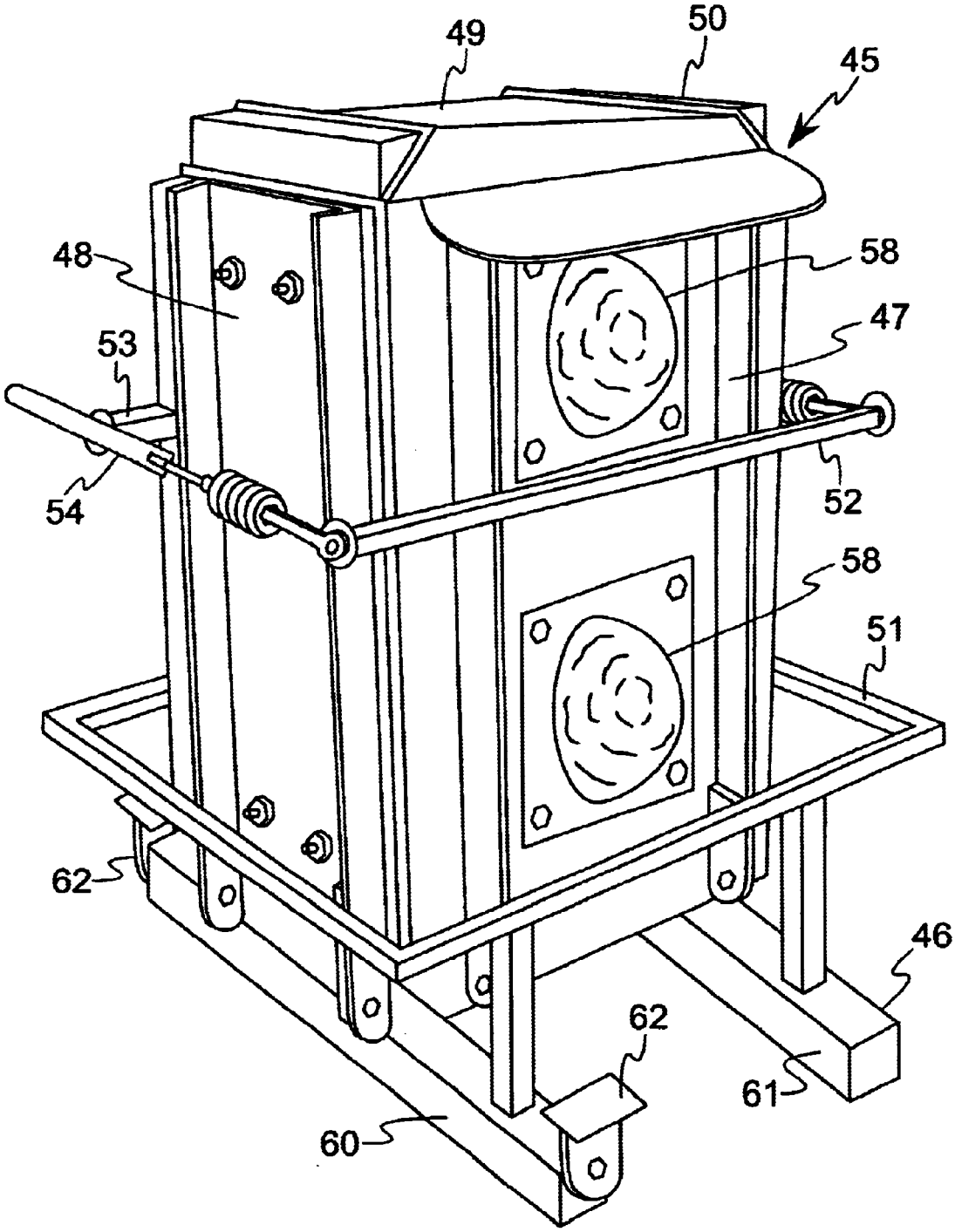
FIG. 7 is a perspective view showing a freestanding form for manufacturing concrete blocks according to the invention, with the form shown in a closed position.
Figure 8:
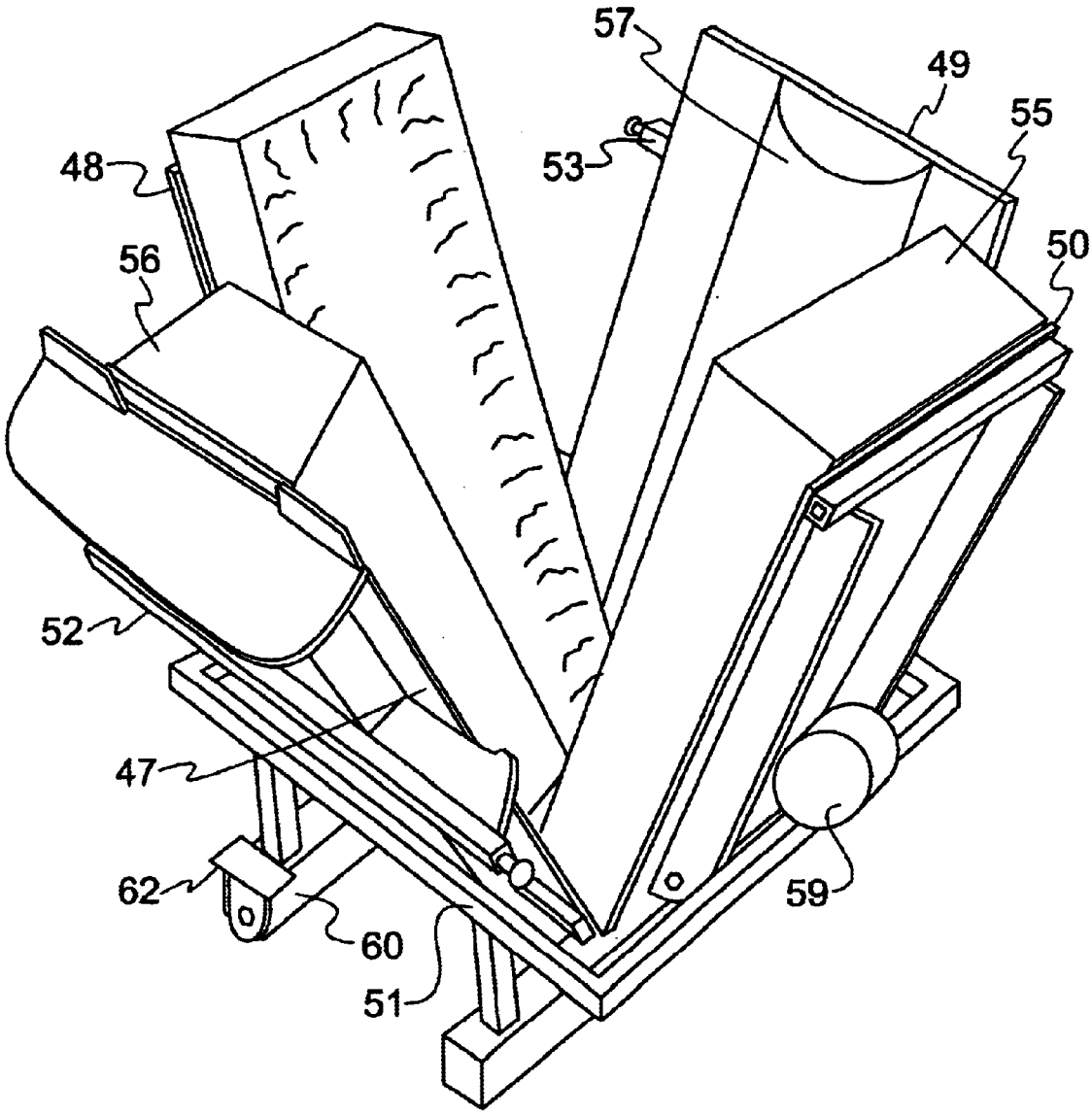
FIG. 8 is a perspective view of a modified embodiment of the form of FIG. 1, with the form shown in an open position.

FIGS. 7 and 8 illustrate a form 45 according to the invention for manufacturing concrete blocks suitable for constructing freestanding walls. The blocks are cast in the form 45 with one end down. When an end of a cast block will be textured, the textured end will be down. The form is adapted to be used with various inserts for forming a textured end to the block, a smooth top surface 13 (FIG. 1) to the block, or a trough 24 in the upper surface (FIG. 2) or a groove 32 (FIG. 3) or 39 (FIG. 5) in the top of the block, for forming the knobs 33 (FIG. 4) on the bottom of the block, or a smooth bottom surface, and for forming an angled end 44*a* or 44*b* (FIG. 6) for a trapezoidal block 42. When a half block is to be cast, either an insert may be place in the form 45 to fill the lower half of the form cavity, or the form may be partially filled with concrete.

The form 45 includes a base 46 on which four side panels 47–50 are mounted to pivot between a closed position (FIG. 7) for casting a block and an open position (FIG. 8) which permits lifting a cast block from the form 45. A bumper frame assembly 51 is mounted on the base 46 to limit the position of the side panels 47–50 when in the open position. A clamp bar assembly 52 is mounted on the side panel 47 and a clamp bar assembly 53 is mounted on the side 49. When the form 45 is in a closed position for casting a concrete block, load binders 54 are secured between the ends of the clamp bar assemblies 52 and 53 adjacent the side 48 and between the ends adjacent the side 50 to hold the form 45 in the closed position. It will be appreciated that other methods may be used for holding the side panels 47–50 in the closed position.

As best seen in FIG. 8, the form 45 includes inserts attached to the side panels 47–50 and to the base 46. A three: sided resilient insert 55 is bolted or otherwise attached to the side panels 48 and 50 and to the base 46 for forming textured sides and a textured end to a concrete block cast in the form 45. The interior sides of the insert 55 may be cast from a natural stone block so as to produce surfaces which closely accurately simulate the natural stone block. An insert 56 is attached to the side panel 47 for producing a trough which stops short of the textured end of the cast block, similar to the trough 24 in the block 18 of FIG. 2. Finally, an insert 57 is attached to the side panel 49 for forming a groove across the bottom of the block parallel to the block sides. If the insert 56 is removed from the side panel 47, two semi-spherical knobs will be formed on the top of the cast block by inserts 58 mounted on the side panel 47.

Although not shown, it should be appreciated that a wire loop or steel rod may be embedded in the upper end of the cast block or attached to a side panel to facilitate lifting the block from the form after the concrete has cured. Such an insert is illustrated in the copending parent published patent application No. US 2001/0026734 A1, the disclosure of which is incorporated herein.

A pneumatically operated vibrator 59 may be attached to one of the side panels 47–50 or to the base 46. The vibrator 59 is operated to shake the form to remove air bubbles from concrete poured into the form 45 before the concrete has set. Other known types of vibrators also may be used with the form 45.

It should be appreciated that by changing the inserts, the form 45 may be adapted for casting the different blocks shown in FIGS. 1–6, as well as blocks having other configurations. A tapered insert (not shown) can be secured to the base 46 for forming one of the angled ends 44*a* or 44*b* of the block 42 shown in FIG. 6. The base 46 includes two skids or parallel supports 60 and 61. Feet or legs 62 are pivotally mounted on opposite ends of the skid 60. As illustrated in FIGS. 7 and 8, the legs 62 are pivoted up and both of the skids 60 and 61 rest on the ground so that the form has a vertical orientation. When a trapezoidal block is to be cast, the legs 62 are pivoted to a position wherein they rest on the ground, spacing the skid 60 above the ground and thus tilting the form 45. Since freshly poured concrete is fluid and will flow, the concrete will flow to form the end 44*a* or 44*b* of the trapezoidal block 42 of FIG. 6 and the other end 44*b* or 44*a* is formed by a tapered insert mounted on the base 46.

Figure 9:
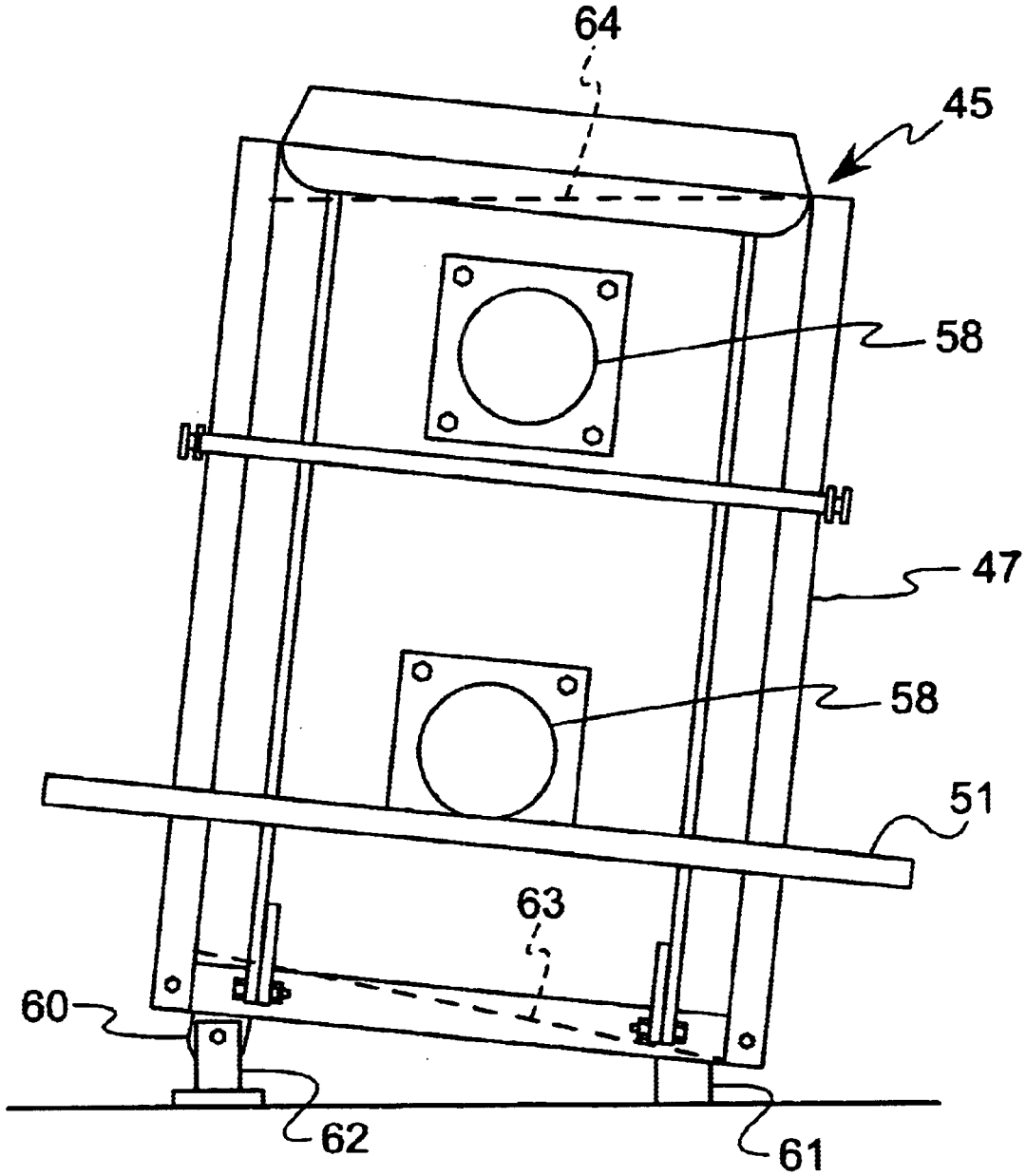
FIG. 9

FIG. 9 is a side elevational view of the form 45, with an insert 63 attached to the base 46 for forming a block 42 of FIG. 6 which may be used to construct a curved wall. The block 42 is trapezoidal when viewed in plan. The insert 63 is tapered to form the angled end 44*b* of the block 42. The legs 62 are pivoted to rest on the ground to tilt the form 45. When the form cavity is filled with concrete, the liquid concrete at an upper surface 64 will flow to form the angled block end 44*a* due to the tilt of the form 45.

Figure 10:
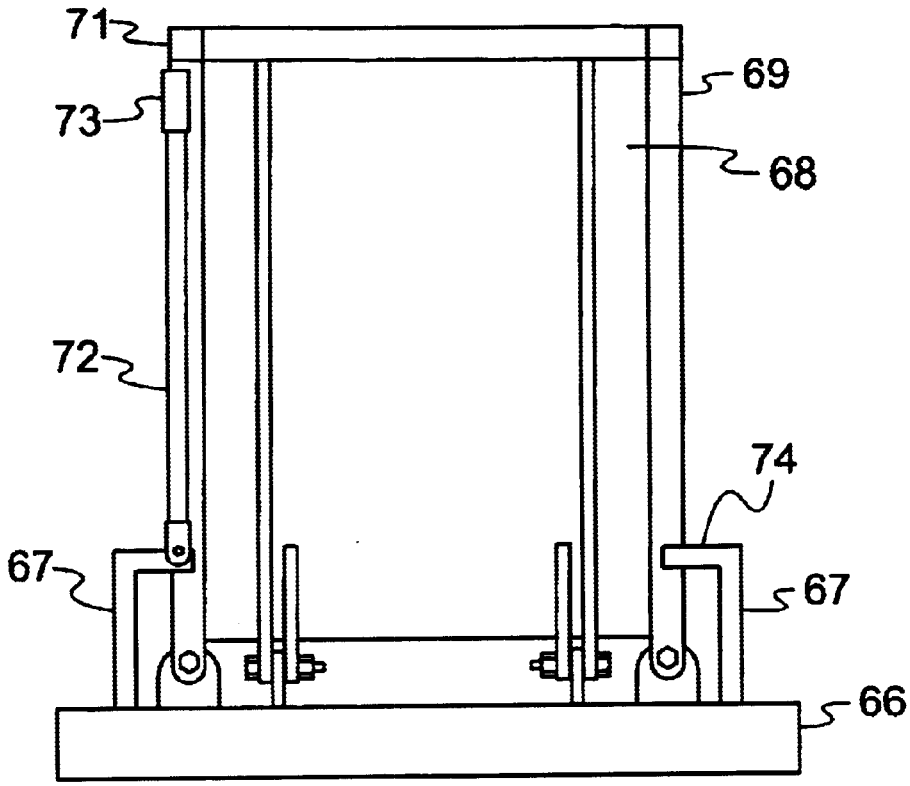
FIG. 10 is a side elevational view of a form according to a modified embodiment of the invention for use in manufacturing concrete blocks, with one side of a bumper frame opened to allow the adjacent form side to pivot to a maximum open position.
Figure 11:
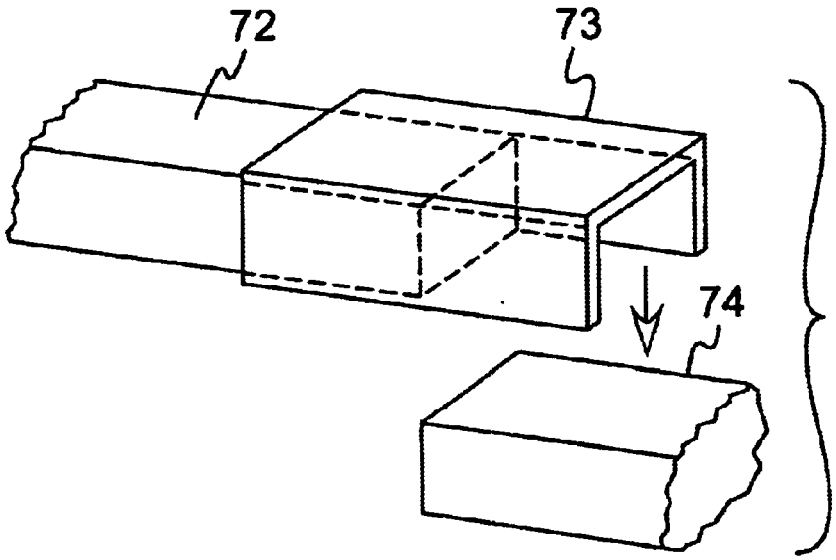
FIG. 11 is a fragmentary perspective view showing details of a latch for the free end of a pivotal section of the bumper frame.
Figure 12:
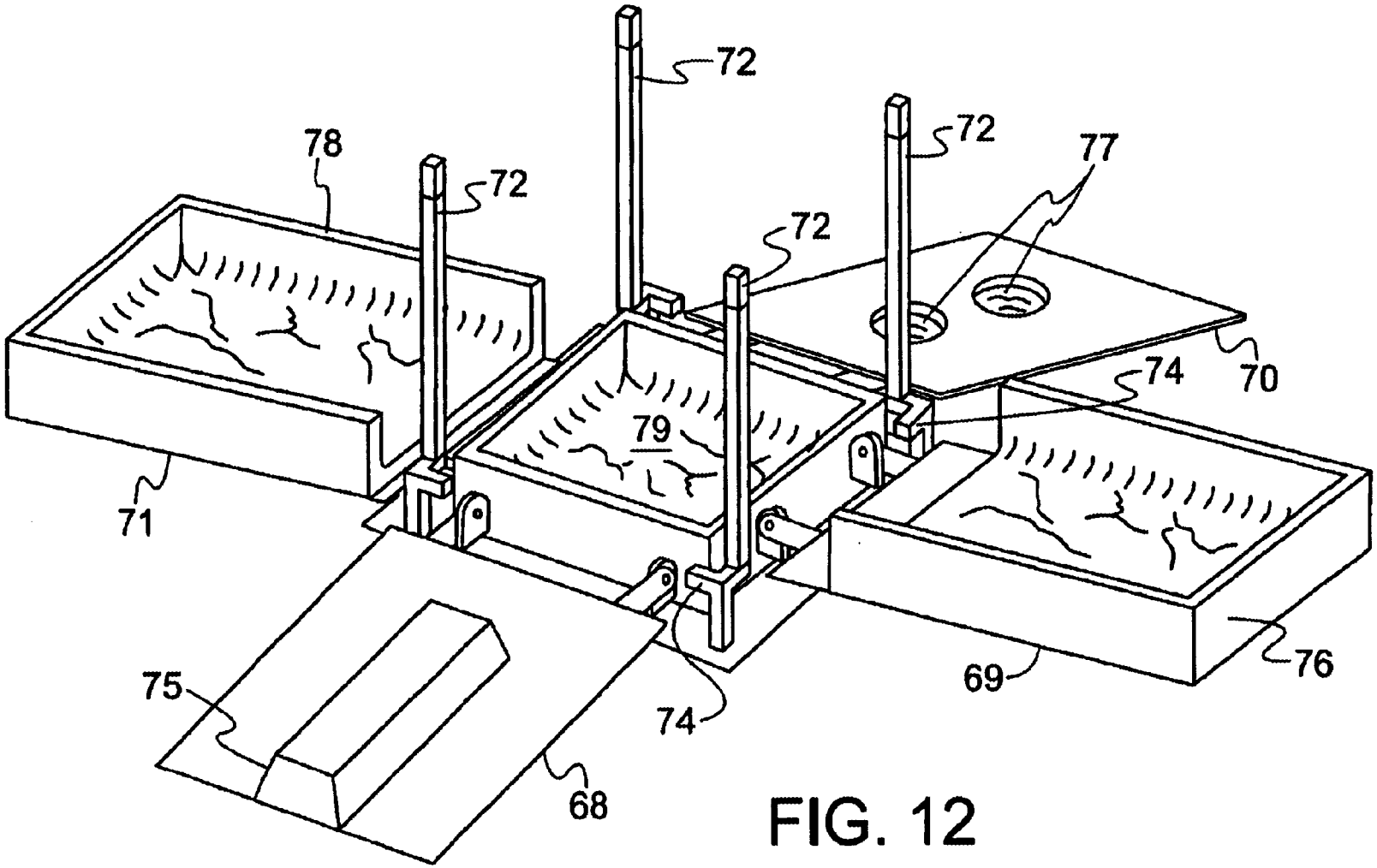
FIG. 12 is a perspective view of the form of FIG. 3 showing the form sides pivoted to a maximum open position.

FIGS. 10–12 show a modified form 65. The form 65 includes a base 66 which mounts a bumper frame 67. Four side panels 68–71 are pivotally attached to the base 66. Each side of the bumper frame 67 includes a pivotal link 72 which may be pivoted to a vertical position as shown prior to moving the side panels 68–71 to the open position. Each pivotal link 72 has a locking member 73 on a free end which engages a section 74 of the bumper frame 67 when in a lowered position to provide strength to the link 72 when supporting a partially open side panel, as shown in FIG. 11. By raising the links 72, the side panels 68–71 may be pivoted down until they rest on the ground. In order to allow the side panels to pivot this far, the inserts mounted on the, base and on the side panels must be separate from each other. The continuous resilient insert 55 shown in FIG. 8 will not permit the sides to pivot to a substantially flat position.

Prior to casting a block in the forms 45 and 65, it is desirable to coat the form with a suitable release agent which facilitates separation of the form from the hardened cast block. Typically, a liquid release agent is sprayed or brushed onto the form. By laying the side panels 68–71 substantially flat, the liquid release agent may be applied to the form sides and an optional powdered coloring agent can be sprinkled onto the side panels and their attached inserts which form exposed surfaces of the cast block when placed in a wall. The powdered coloring agent will stick sufficiently to the liquid release agent while the side panels are moved to and locked in their closed position and while the form is being filled with concrete. The powdered coloring agent will bond to and color the exposed sides of the cast block. In the embodiment of the form 65 shown in FIG. 11, inserts 75–78 are mounted, respectively, on the side panels 68–71 and an insert 79 is mounted on the base 66. The insert 75 forms a trough in the top of the cast block, the inserts 76 and 78 form a textured sides on the cast block, the insert 77 forms knobs on the bottom of the cast block, and the insert 79 forms a textured end to the cast block. Consequently, the form 65 is set up to cast the block 18 of FIG. 2. Since coloring agent need not be applied to the top and bottom of the cast block, it should be appreciated that the links 72 on the bumper frame 67 for the side panels 68 and 70 may be left down and only the side panels 69 and 71 which form the exposed textured sides and end may be lowered to facilitate coating with the coloring agent.

Figure 13A:
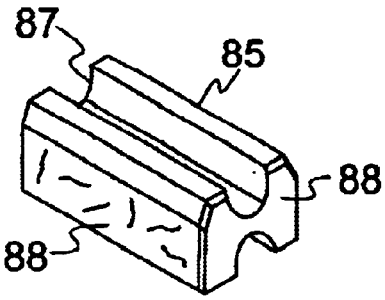
FIG. 13, which is composed of FIGS. 13*a*–13*h*, are examples of various freestanding wall blocks which can be cast in the form of the present invention.
Figure 13B:
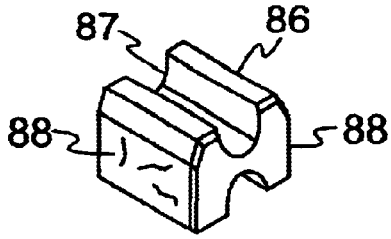
Figure 13C:
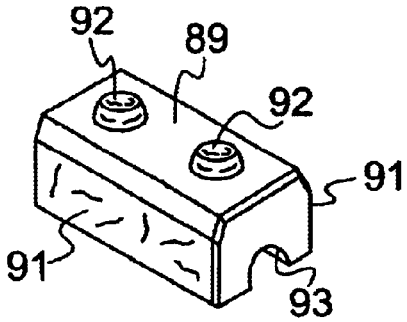
Figure 13D:
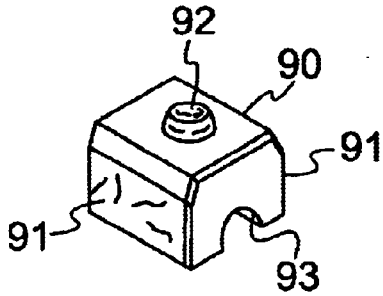
Figure 13E:
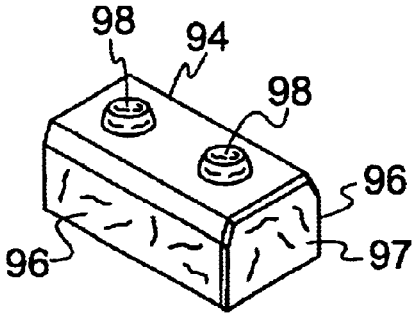
Figure 13F:
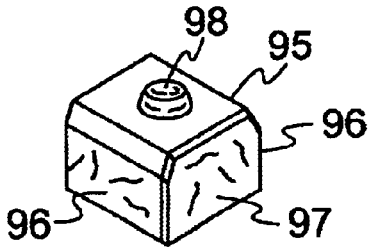
Figure 13G:
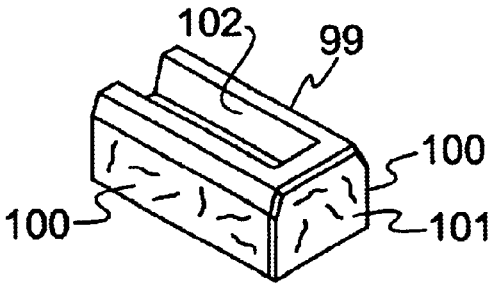
Figure 13H:
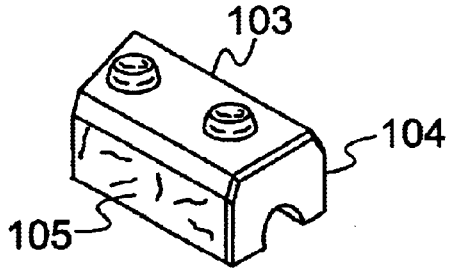

FIGS. 13*a* through 13*h* are examples of a number of different freestanding wall blocks which can be manufactured in the above described forms. FIG. 13*a* shows a garden top block 85 and FIG. 13*b* shows a garden half top block 86. The blocks 85 and 86 each have a recess or trough 87 which can be filled with soil and plants. Exposed sides 88 of the blocks 85 and 86 are textured to simulate natural stone. FIG. 13*c* shows middle block 89 for a free standing wall or barrier and shows a half middle block 90. The blocks 89 and 90 each have opposed, exposed sides 91 which are textured to simulate natural stone, at least one projection or knob 92 on the top and a groove 93 on the bottom. If desired, the blocks 89 and 90 can be inverted so that the knobs 92 are on the bottom and the groove 93 is on the top. FIG. 13*e* shows a bottom block 94 suitable for use on an end of a freestanding wall or barrier, and FIG. 13*f* shown a half bottom block 95. The blocks 94 and 95 each have opposed textured sides 96 and an exposed end 97 which preferably simulate natural stone. The blocks 94 and 95 also have at least one top projection 98 for interlocking with a block placed on top of the blocks 94 and 95. If the blocks 94 and 95 are to be used in the bottom row of blocks, they may have a flat bottom. If the blocks 94 and 95 are to be used above a bottom row of blocks, they will have a bottom groove which stops short of the textured face 97 so as to not be visible at the finished end of the wall. FIG. 13*g* shows an end garden block 99 for use on the top of a wall or barricade. The block 99 has opposed textured sides 100 and an exposed textured end 101 which preferably simulate natural stone. A recess or trough 102 is formed in the top of the block 99 to stop short of the exposed end 101. FIG. 13*h* shows a middle block 103 for use in forming a curved wall or barrier. The block 103 has two exposed sides 104 and 105 which are textured for simulating natural stone. The side 105 is shorter than the side 104. Otherwise, the block 103 is identical to the block 89 of FIG. 13*c*. From viewing the blocks of FIGS. 13*a* through 13*h*, it will be apparent that the forms for manufacturing the blocks are versatile in that the forms can be used for manufacturing a wide variety of blocks by merely changing inserts attached to the side panels and bottom of the form.

Although the blocks described herein are described for use in freestanding walls and barricades, it should be appreciated that they also may be used, either alone or in combination with blocks of other designs, for constructing retaining walls.

What is claimed is:

1. A form for casting concrete blocks having first and second opposed textured sides simulating natural stone, first and second opposed ends, a top and a bottom, said form comprising a base, first, second, third and fourth side panels attached to said base to pivot between a first position forming a cavity having an open top and a closed bottom and a second position wherein upper ends of said side panels are separated to allow removal of a cast block from said form, means for connecting said side panels together when in said first position, said first and third side panels forming opposite sides of said cavity which cast the opposed sides of the block and said second and forth side panels forming opposite sides of said cavity which cast the top and the bottom of the block, a first insert secured to the cavity side of said first side panel, said first insert having a textured surface for imparting a natural stone appearance to one side of the block, and a second insert secured to the cavity side of said third side panel, said second insert having a textured surface for imparting a natural stone appearance to the other side of the block, and further including a third insert secured to the bottom of said form, said third insert forming the first end of the block at angles less than 90° to the first side of the block and greater than 90° to the second side of the block whereby the first side of the block is longer than the second side of the block, and further including means for tilting said form whereby the top of the block is generally trapezoidal.

2. A method for casting a concrete block having a generally trapezoidal top and bottom, first and second generally rectangular sides, and first and second generally rectangular ends, comprising the steps of:

a) providing a form having a cavity with side panels for forming the sides, top and bottom of the block, a bottom angled relative to said side panels which form the sides of the block for forming the first end of the block, and an open top wherein the second end of the block is formed;

b) tilting the form at an angle for forming the second end at an equal and opposite angle to the angle of said first end; and c) casting a concrete block in the tilted form.

3. A method for casting a concrete block, comprising the steps of:

a) providing a form having a cavity including a generally vertical side and a bottom extending at a predetermined angle to a horizontal plane, and an open top;

b) tilting the form at the predetermined angle in a direction for forming an upper end to a block cast in the cavity at an angle to the generally vertical cavity side equal and opposite to the angle of the cavity bottom; and c) casting a concrete block in the tilted form.

* * * * *